US006166754A

United States Patent [19]

Yamamoto et al.

[11] Patent Number: 6,166,754

[45] Date of Patent: Dec. 26, 2000

[54] THERMAL TRANSFER TYPE IMAGE FORMING DEVICE

[75] Inventors: Takemi Yamamoto; Naoto Iwao, both of Nagoya, Japan

[73] Assignee: Brother Kogyo Kabushiki Kaisha, Nagoya, Japan

[21] Appl. No.: 09/064,747

[22] Filed: Apr. 23, 1998

[30] Foreign Application Priority Data

| | | | |
|---|---|---|---|
| Apr. 25, 1997 | [JP] | Japan | 9-108645 |
| Apr. 25, 1997 | [JP] | Japan | 9-108646 |
| May 12, 1997 | [JP] | Japan | 9-120565 |

[51] Int. Cl.[7] ..... B41J 2/32

[52] U.S. Cl. ..... 347/213

[58] Field of Search ..... 347/213, 171, 347/172, 173, 174, 176; 400/120.01, 120.02, 120.04

[56] References Cited

U.S. PATENT DOCUMENTS

| | | |
|---|---|---|
| 4,080,897 | 3/1978 | Gundlach . |
| 4,369,451 | 1/1983 | Sekido et al. . |
| 4,462,035 | 7/1984 | Koto . |
| 5,008,690 | 4/1991 | Koizumi et al. . |
| 5,170,187 | 12/1992 | Oikawa . |
| 5,708,468 | 1/1998 | Iwao . |

FOREIGN PATENT DOCUMENTS

| | | | |
|---|---|---|---|
| 56-089967 | 7/1981 | Japan . | |
| 61-272174 | 12/1986 | Japan | 347/213 |
| 1-21789 | 4/1989 | Japan . | |
| 01-186351 | 7/1989 | Japan . | |
| 4-41284 | 2/1992 | Japan . | |
| 4-126283 | 4/1992 | Japan . | |
| 5-238028 | 9/1993 | Japan . | |

*Primary Examiner*—Huan Tran
*Attorney, Agent, or Firm*—Oliff & Berridge, PLC

[57] ABSTRACT

An image forming device including a plurality of image forming units each for forming an image on an intermediate transfer body using one of different colored inks. Different colored images are selectively formed in an overlapping relation on the intermediate transfer body, thereby forming a multicolor image thereon. Each different colored image is formed by a thermal transfer operation in which ink on an ink holding member is heated, melted, and then transferred directly onto the intermediate transfer body or onto an existing ink image on the intermediate transfer body. Heat to be supplied to the ink to be transferred onto the existing ink image is insufficient to melt ink in the existing ink image.

23 Claims, 7 Drawing Sheets

PRIOR ART

PRIOR ART

THERMAL TRANSFER TYPE IMAGE FORMING DEVICE

BACKGROUND OF THE INVENTION

1. Field of the Invention

The present invention relates to a thermal transfer type image forming device for forming an image using hot melt ink.

2. Description of Related Art

As shown in FIG. 1, a conventional thermal transfer type image forming device 401 includes a thermal head unit 410, an ink supply medium 420 serving as an ink carrying member, and a thermal transfer mechanism 430. The thermal head unit 410 includes a head 411 and a driving source 412. Although not shown in the drawings, the head 411 has a plurality of heating elements each connected to the driving source 412. The driving source outputs driving signals to the heating elements based on image signals transmitted from a control circuit. Upon receiving the driving signals, the heating elements selectively generate heat. The ink supply medium 420 has a base film 412 and a hot melt ink layer 422 formed on the base film 412. The thermal-transfer mechanism 430 has a platen roller 432 positioned in confrontation with the head 411 with the ink supply medium 420 and a recording medium 431 sandwiched therebetween. By being selectively driven, the heating elements thermally transfer the ink from the hot melt ink layer 422 onto the recording medium 431. That is, heat generated by the driven heating elements melts the ink in the hot melt ink layer 422. The melted ink is then supplied onto the recording medium 431, thereby forming an image on the recording medium 431.

Thermal transfer of ink onto the recording medium 431 as shown in FIG. 1 forms ink voids 422*a* and ink regions 422*b* in the ink layer 422 of the ink supply medium 420. Therefore, the ink supply medium 420 can be used only once. More specifically, because the heating elements of the head 411 are selectively driven to thermally transfer ink at only selected positions of the ink layer 422, the ink at only the selected positions is transferred onto the recording medium 430. As a result, almost no ink is left on the base film 421 at the selected positions. These selected positions correspond to the ink voids 422*a*. Although ink remains at the ink regions 422*b* on the base film 421 at unselected positions, the ink supply medium 420 cannot be reused because of the voids 422*a*. The ink supply medium 420 is disposed with after only a single use, resulting in wasting a large amount of ink and increasing running costs.

In order to overcome this problem, Japanese Patent-Application Publication (Kokai) (hereinafter referred to as "JP") No. HEI-5-238028 described an image forming device in which an ink carrying member is recovered after used. The image forming device includes an ink tank containing ink. Ink in the ink tank is kept in its melted state by a heater. The melted ink is supplied from a cylindrically-shaped ink supply portion onto an ink support film serving as an ink carrying member. However, a great amount of energy is required for maintaining ink in its melted state in the ink tank. This increases the running cost.

Also, JP No. HEI-4-126283 describes an image forming device having an ink carrying member capable of being used repeatedly. The ink carrying member is a thermal-transfer sheet made from a foamed resin which is holding ink. Because ink is oozed out to a surface of the sheet by a recording head as needed, the ink carrying member can be used repeatedly without having voids. However, the ink carrying member is not durable for a long period of time because the resin containing ink may be easily degraded by being subjected to heat during repeated thermal transfer operation. Also, because the resin has poor heat conducting properties, its temperature increases and decreases at a relatively slow rate. This limits the speed of printing operations.

In U.S. Pat. No. 5,708,468, the present applicant has proposed a thermal transfer type image forming device 501 shown in FIG. 2. Ink melted from a hot melt ink member 510 by a heater 520 is supplied onto an ink retaining roller 530. A peripheral surface of the ink retaining roller 530 is made of a foamed resin in which the ink is held. When the ink is brought into a confrontation with a thermal head 550 as the ink retaining roller 530 rotates, the thermal head 550 selectively generates heat to melt the ink so that the melted ink is transferred onto a recording medium 540 positioned between the ink retaining roller 530 and the thermal head 550. After the ink is transferred onto the recording medium 540, the ink retaining roller 530 is resupplied with ink. In this way, the ink retaining roller 530 is repeatedly used.

As shown in FIG. 2, the thermal head 550 is disposed such that the recording medium 540 is interposed between the thermal head 550 and the ink retaining roller 530. Because heat generated by the thermal head 550 is supplied to the ink on the ink retaining roller 530 from a side close to the recording medium 540, only the ink held close to the recording medium 540 can be effectively transferred onto the recording medium 540.

However, heat from the thermal head 550 may not be supplied to the ink because of a thickness of the recording medium 540 or a material forming the recording medium 540. In this case, the ink will not be transferred onto the recording medium 540.

There has been also proposed a tandem type image forming device including a plurality of image forming units and an intermediate transfer body. Each image forming unit transfers one of different colored inks onto the intermediate transfer body. The inks from the image forming units collectively form a multicolored image. That is, different colored images are formed in an overlapping relation by the image forming units so as to form a single multicolored image.

This type of image forming device can form a multicolored image in a relatively short time, and it is necessary for each image forming unit to operate in synchronization and transfer ink in a uniform time duration.

However, in a thermal transfer tandem type image forming device, when one of the image forming units thermally transfers ink onto an existing ink image, the ink in the existing image is also heated. This may melt the ink of the existing image also, and disturb and blur the overall image.

In order to overcome these problems, JP No. HEI-4-41284 proposed to use different colored inks having different melting points. However, each colored ink with different melting point takes a different time duration to be thermally transferred. Because, in a tandem type image forming device, it is necessary for each image forming unit to operate in synchronization and transfer ink in a uniform time duration as described above, it has been difficult to configure a tandem type image forming device using different colored inks each having a different melting point.

Further, there has been known an image forming device including a laser unit for emitting laser beams and an ink carrying member having an ink layer formed on a transparent substrate. Laser beams are selectively irradiated onto designated spots on the ink holding member so that ink at the spots is thermally transferred onto a recording medium. Because the laser beam can be irradiated on an extremely small spot, an image with high resolution can be obtained.

However, the laser unit outputs only a small amount of heat compared to heat energy required to thermally transfer hot melt ink. Therefore, it takes a relatively long time for the laser unit to melt the hot melt ink. In order to overcome this problem, Japanese Patent-Application Publication (Kokoku) No. HEI-1-21789 proposed an image forming device having a preheating unit for preheating an ink layer of an ink carrying member. A control mechanism controls the amount of heat generated by the preheating unit in accordance with a detected temperature of the ink layer. With this configuration, the laser unit requires less energy, that is, less time, to melt the preheated ink.

However, the additional components, that is, the preheating unit and the control mechanism, increase the size of the image forming device and complicate its structure, resulting in increasing manufacturing costs of the device.

SUMMARY OF THE INVENTION

It is an object of the present invention to overcome the above and other problems and also to provide an image forming device capable of forming an image on a recording medium regardless of variety in a thickness of the recording medium.

It is another object to provide an image forming device having an ink carrying member which is capable of being used repeatedly for a long period of time without wasting ink.

It is still another object of the present invention to provide a tandem type image forming device including a plurality of thermal transfer type image forming units each capable of forming an image in a uniform time duration without disturbing a previously formed image.

Further, it is another object of the present invention to provide a thermal transfer type image forming device having a simple structure, capable of forming images with a high resolution in a short time, and requiring a small amount of energy.

It is also an object of the present invention to provide a method of performing a thermal transfer operation.

To achieve the above and other objects, there is provided an image forming device including an intermediate medium and an image forming unit for forming an image on the intermediate medium. The image forming unit includes a hot melt ink supporting member, a heater, an ink carrying member, and a thermal transferring member. The hot melt ink supporting member supports hot melt ink that is solid at room temperature and melted when heated. The heater is disposed in contact with the hot melt ink that is solid at room temperature. The heater generates heat to melt ink from the hot melt ink. The ink carrying member is movably disposed in contact with the heater. The ink carrying member is supplied with ink melted from the hot melt ink to hold and carry the ink. The ink carrying member is partially contacting the intermediate medium which is movable relative to the ink carrying member. The thermal transferring member selectively transfers ink held on the ink carrying member onto the intermediate medium by selectively applying heat to the ink carrying member.

There is also provided an image forming device including a hot melt ink supporting member, a heater, an ink carrying member, a recording medium supplying member, and a thermal transferring member. The hot melt ink supporting member supports hot melt ink that is solid at room temperature and melted when heated. The heater is disposed in contact with the hot melt ink that is solid at room temperature. The heater generates heat to melt ink from the hot melt ink. The ink carrying member is movably disposed in contact with the heater. The ink carrying member is supplied with ink at a first position to transport the ink to a second position remote from the first position. The recording medium supplying member supplies a recording medium to the second position at which the recording medium contacts the ink carrying member. The thermal transferring member selectively transfers ink held on the ink carrying member onto the recording medium at the second position. The ink on the ink carrying member is cooled to be a semi-solid state when moved to the second position from the first position so as not to allow the semi-solid state ink to be transferred onto the recording medium when the thermal transferring member does not apply heat to the ink carrying member.

There is also provided a method of forming an image on a medium with an $n^{th}$ image forming unit of a plurality of image forming units. The method including the step of supplying heat $Q_n$ to ink held on an ink carrying member for heating the ink to a temperature $T_n$ so that the ink is transferred onto a medium; wherein $$C_n W_n (T_n - T_r) \leq Q_n < (T_{n-1} - T_r) \sum_{m=1}^{n-1} C_m W_m$$

wherein $T_r$ is room temperature; $W_n$ is a weight of the ink; and $C_n$ is a heat capacity of the ink.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Figure 1:
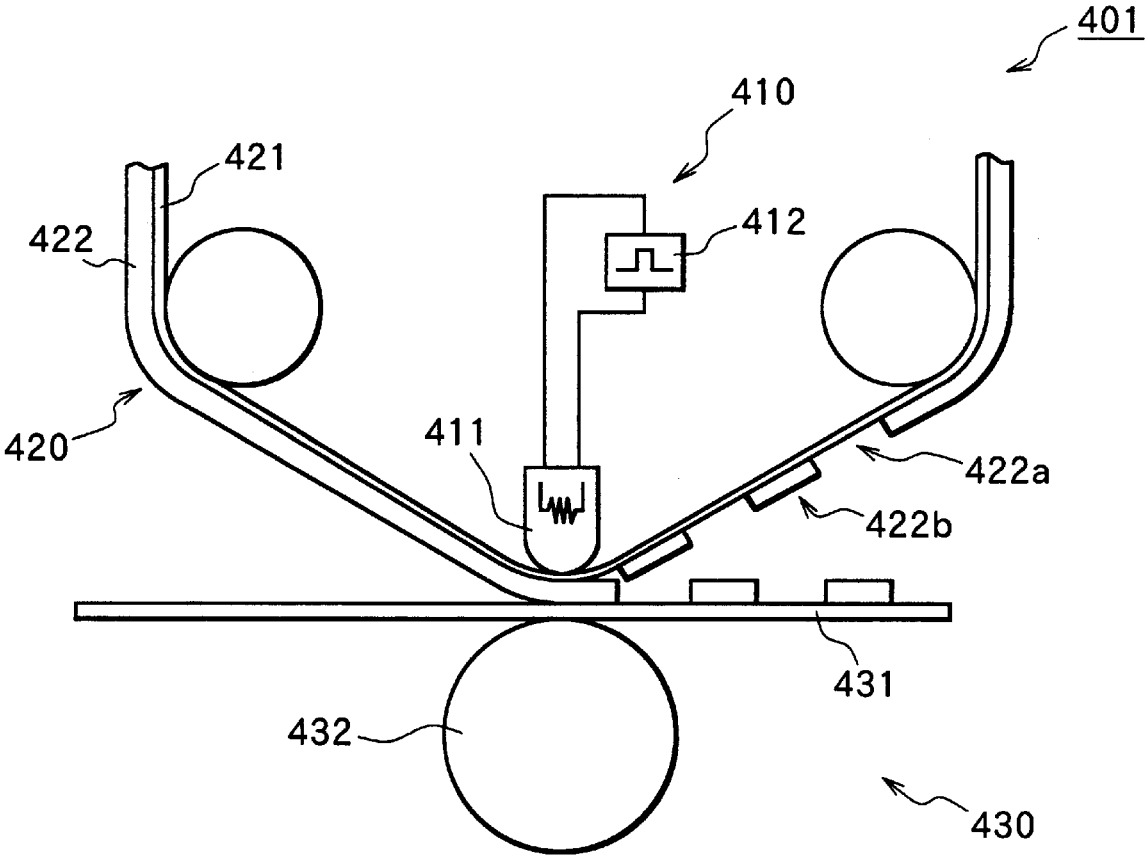
FIG. 1 is a plan view showing a conventional image forming device.
Figure 2:
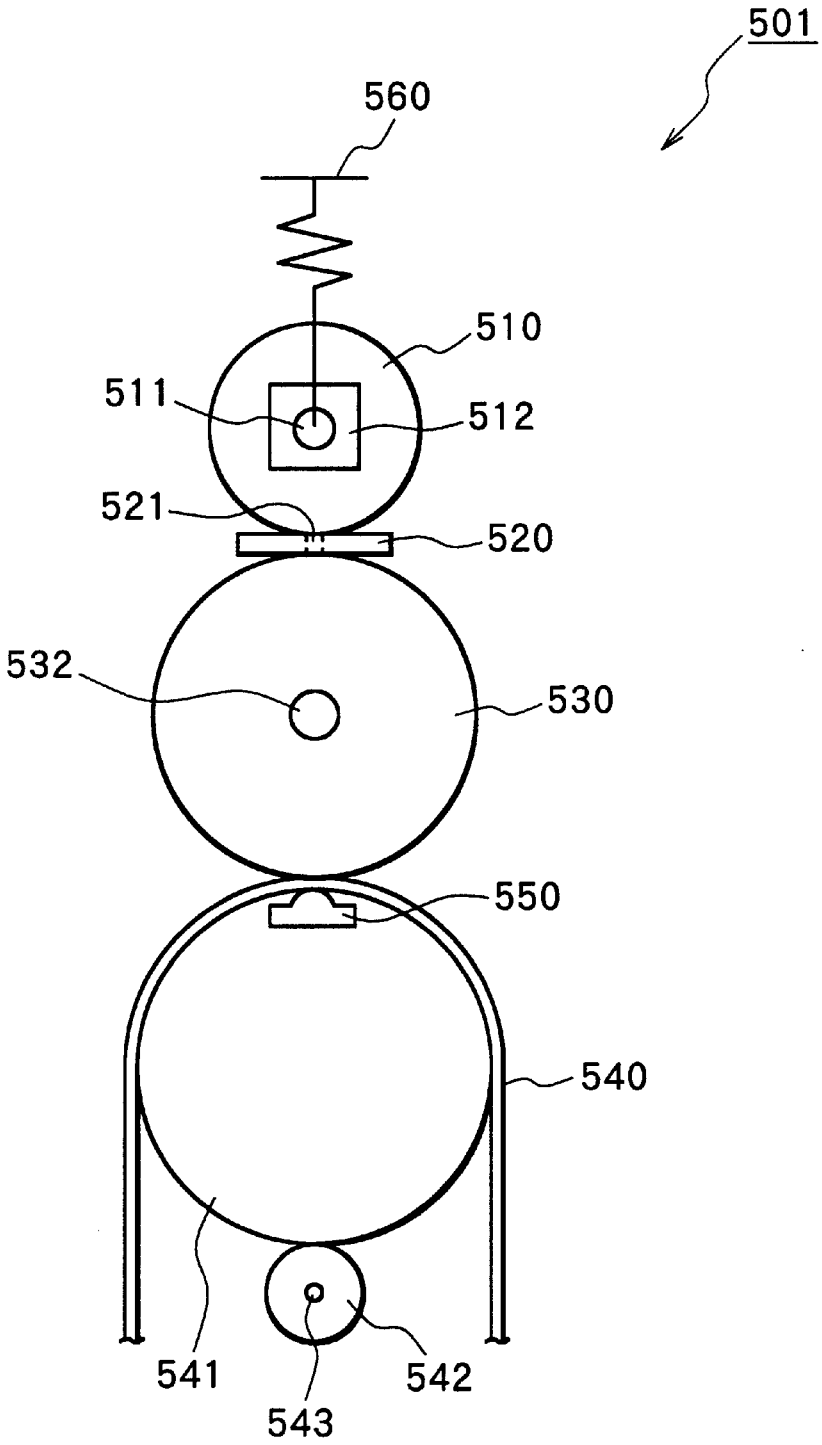
FIG. 2 is a partial plan view showing another conventional image forming device proposed by the present applicant.

Image forming devices according to preferred embodiments of the present invention will be described while referring to the accompanying drawings wherein like parts and components are designated by the same reference numerals to avoid duplicating description.

Figure 3:
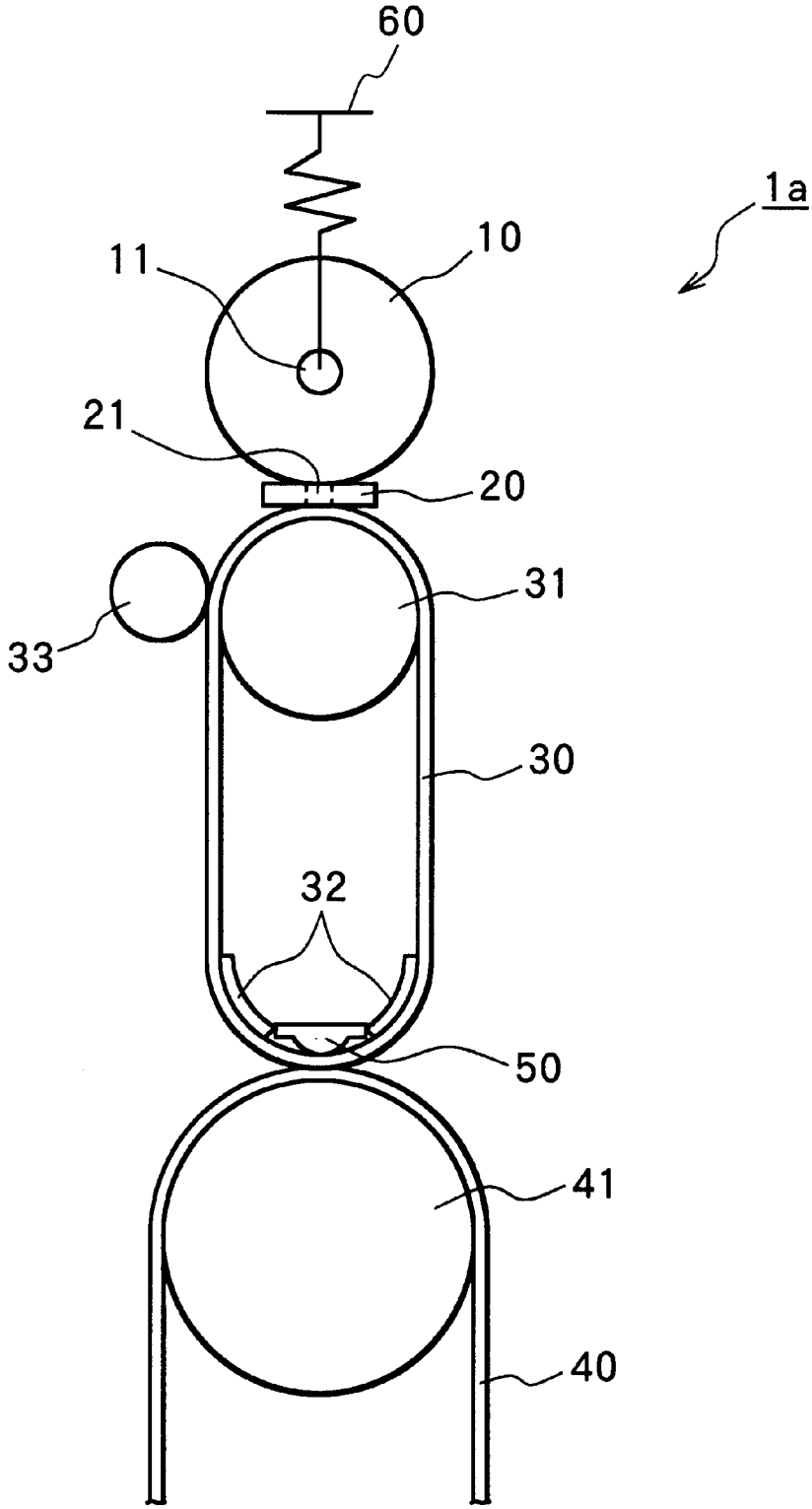
FIG. 3 is a plan view showing an image forming device according to a first embodiment of the present invention.

First, an image forming device 1*a* according to a first embodiment of the present invention will be described while referring to FIG. 3. As shown in FIG. 3, the image forming device 1*a* includes a hot melt ink member 10, a shaft 11, a feed roller 31, a pressing roller 33, arched guides 32, a thermal head 50, an urging member 60, a heater 20, an ink carrying member 30, and a sheet feed roller 41.

The hot melt ink member 10 is in its solid state at room temperature and melts when heated. The hot melt ink member 10 is formed in a cylindrical shape around the shaft 11. A motor (not shown in the drawings) drives the shaft 11 to slowly rotate so that the hot melt ink member 10 rotates accordingly.

The arched guides 32 and the thermal head 50, which has an arch-shaped surface, are disposed in confrontation with the sheet feed roller 41. The ink carrying member 30 is an endless belt shape wound around the feed roller 31, the thermal head 50, and the arched guides 32, and is sandwiched between the ink member 10 and the feed roller 31 and also between the thermal head 50 and the sheet feed roller 41. The pressing roller 33 is disposed to press against the ink carrying member 30. A motor (not shown) drives the feed roller 31 to rotate in a clockwise direction in FIG. 3. Rotational movement of the feed roller 31 feeds the ink carrying member 30 in the clockwise direction in FIG. 3.

The feed roller 31 is disposed in confrontation with the hot melt ink member 10. The heater 20 is interposed between the hot melt ink member 10 and the feed roller 31. The heater 20 is a thin-film heater made from stainless steel, and is formed with an elongated through-hole 21. The urging member 60 urges the hot melt ink member 10 toward the feed roller 31. In this way, upper and lower surfaces of the heater 20 contact the hot melt ink member 10 and the feed roller 31, respectively. The through-hole 21 exposes the hot melt ink member 10 to the ink carrying member 30. The hot melt ink member 10, the feed roller 31, the heater 20, and the through-hole 21 of the heater 20 all extend in parallel with each other in a longitudinal direction, that is, a direction perpendicular to the sheet surface of FIG. 3. In this embodiment, the dimension of each component in the longitudinal direction will be referred to as its width. The width of the through-hole 21 is equal to or slightly smaller than the width of the ink carrying member 30, and also equal to or slightly greater than the width of the hot melt ink member 10. Although not shown in the drawings, the heater 20 has a resister electrically connected to a power source. The resister is disposed on either entire or partial upper surface of the heater 20. The resister generates heat upon receiving electric power from the power source. The heat from the resister gradually melts the rotating hot melt ink member 10 evenly from the outer peripheral surface of the hot melt ink member 10. Melted ink flows down through the through-hole 21 onto the ink carrying member 30.

The ink carrying member 30 is a sheet-like member which is formed of ceramic fibers bound by a binder, such as a resin. The ceramic fibers are formed to a diameter of about 2 $\mu$m from a material containing alumnae and silica by thermal processes. The ceramic fibers have a melting point of 1700° C. The ink carrying member 30 has excellent heat resistance and electric insulating properties, and also has numerous apertures or spaces therein. The melted ink supplied to the ink carrying member 30 through the through-hole 21 spreads throughout the apertures, where the ink solidifies.

The thermal head 50 has a plurality of resisters (not shown) arranged in a resister line on the arch-shaped surface. The resister line extends parallel with the feed roller 31 to a width equal to the width of the ink carrying member 30. The resisters are individually connected to a control circuit (not shown) and selectively generate heat upon receiving electric signals from the control circuit.

The sheet feed roller 41 is disposed in confrontation with the thermal head 50 with the ink carrying member 30 sandwiched therebetween. The sheet feed roller 41 is driven by a motor (not shown) to rotate at the same peripheral speed as the feed roller 31. A switching mechanism (not shown) is provided for selectively moving the sheet feed roller 41 between a contact position and a retracted position. When the sheet feed roller 41 is at the contact position, the sheet feed roller 41 contacts the ink carrying member 30 and a thermal-transfer operation to be described later is performed. On the other hand, when the sheet feed roller 41 is at the retracted position, the sheet feed roller 41 is separated from the ink carrying member 30, and a recording medium 40 is supplied between the sheet feed roller 41 and the ink carrying member 30. It should be noted that the feed roller 31 and the sheet feed roller 41 can be driven by a same single motor.

Next, an operation of the above-described image forming device 1*a* will be described. First, the heater 20 generates heat to melt the hot melt ink member 10. Melted ink flows down through an entire area of the through-hole 21 onto the ink carrying member 30 while the ink carrying member 30 is fed by the feed roller 31. The ink spreads throughout the apertures or spaces in the ink carrying member 30 and is held in the apertures. In this way, an entire peripheral surface of the ink carrying member 30 is supplied with ink. The ink in the apertures is conveyed toward the thermal head 50 as the ink carrying member 30 is fed by the feed roller 31. The ink cools and solidifies by the time it reaches the thermal head 50.

At the same time, the sheet feed roller 41 is supplied with a recording medium 40 and is moved from the retracted position to the contact position so that the recording medium 40 is sandwiched between the sheet feed roller 41 and the ink carrying member 30. Then, the thermal head 50 performs the thermal transfer operation to form an image on the recording medium 40. Specifically, the resisters of the thermal head 50 selectively generate heat based on an image signal. The heat from the thermal head 50 heats up a portion of the ink carrying member 30. Ink held in the heated portion is melted and transferred onto the recording medium 40 as a result. The ink solidifies on the recording medium 40 and forms one line worth of dot pattern thereon. Then, both the ink carrying member 30 and the recording medium 40 are fed by the same distance at the same speed by the feed roller 31 and the sheet feed roller 41, respectively. Dot patterns for subsequent lines are formed on the recording medium 40 by repeating the above-described thermal transfer operation. In this way, a desired image is formed on the recording medium 40.

After the thermal transfer operations described above, the ink carrying member 30 has voided portions with no ink. However, the voided portions are brought to the through-hole 21 by rotation of the feed roller 31. Ink is supplied through the through-hole 21 onto the voided portions. Therefore, printing operations can be performed continuously without the ink carrying member 30 being replaced until the hot melt ink member 10 is used up. When the hot melt ink member 10 runs out, the hot melt ink member 10 is detached from the urging member 60 and replaced with an unused hot melt ink member 10.

Because the ink carrying member 30 is repeatedly supplied with ink, ink which has not been transferred onto the recording medium 40 will not be wasted, thereby reducing running costs. Also, because the ink carrying member 30 is made of a ceramic material, it has excellent heat resistance and durability, and so can be used for a long period of time. Further, because the ceramics has a small thermal capacity per area, its temperature quickly increases when subjected to heat, and also decreases when heat supply is stopped. As a result, the speed of printing operations can be increased.

As the hot melt ink member 10 is evenly used from outer peripheral surface while rotated by the shaft 11, its radius gradually decreases. However, the urging member 60 urges the hot melt ink member 10 toward the heater 20 so that the hot melt ink member 10 constantly contacts the heater 20. Therefore, the heater 20 can melt the hot melt ink member 10 regardless of its size. This ensures that the ink carrying member 30 is supplied with ink.

The ink carrying member 30 can be also formed with through-holes extending in a thickness direction of the ink carrying member 30. In this case, the melted ink is also held and solidified in the through-holes. Because, during thermal transfer operations, ink held in the through-holes flows only to the direction in which the through-holes extend, that is, a downward direction in FIG. 4, ink on the recording medium 40 is prevented from blurring, and therefore, images in a excellent resolution can be obtained. Also, by uniformly forming the through-holes in an entire surface of the sheet member 30, each dot in an image formed on the recording medium 40 can be formed with an uniform amount of ink. This enables to form the image without variation in an ink density. That is, ink amount on the sheet member per area can be uniform.

Figure 4:
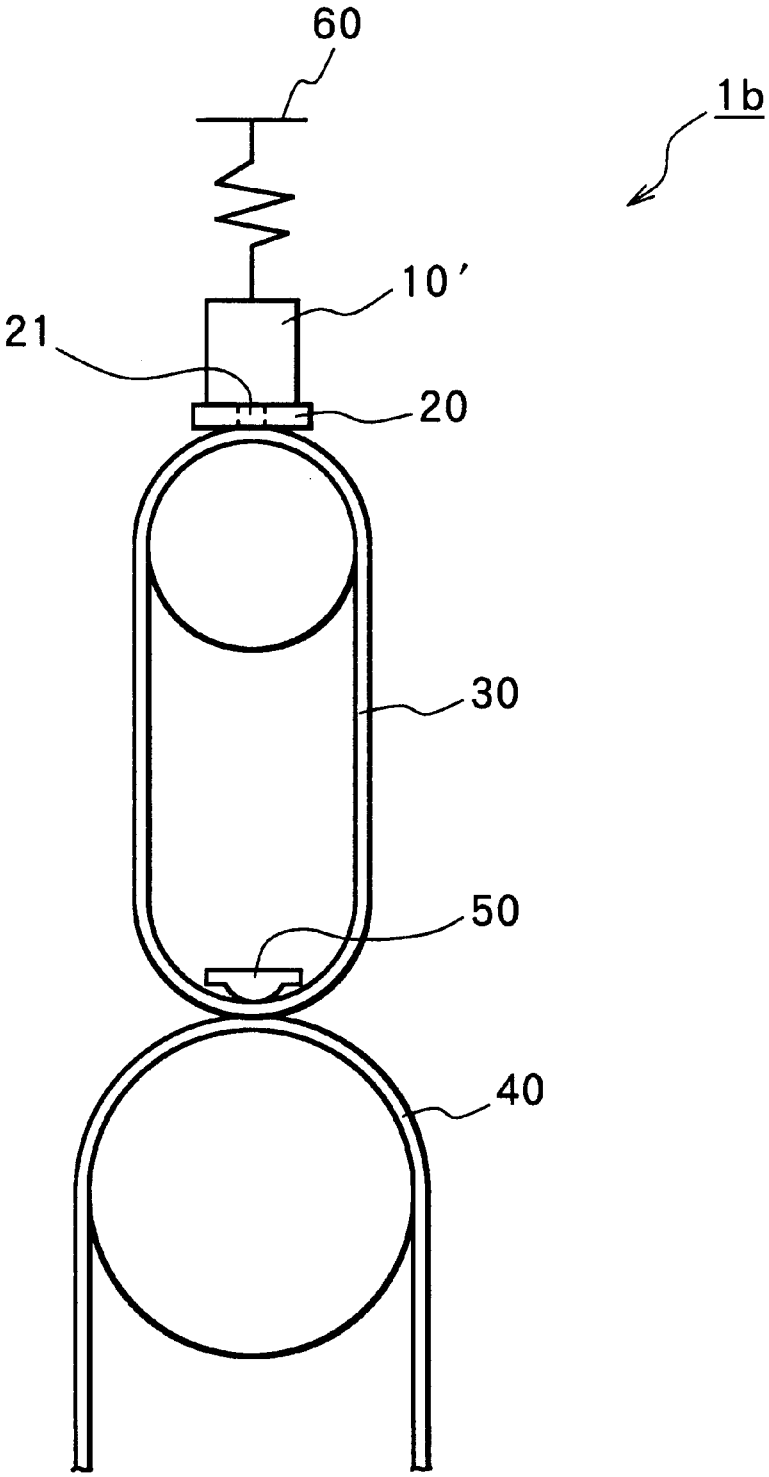
FIG. 4 is a plan view showing an image forming device according to a second embodiment of the present invention.

Next, an image forming device 1*b* according to a second embodiment of the present invention will be described while referring to FIG. 4. The image forming device 1*b* is basically the same as the image forming device 1*a* except a hot melt ink member 10' has a prism shape rather than a roller shape. With the hot melt ink member 10', a structure of the image forming device 1*b* can be less complicated than the image forming device 1*b* with the hot melt ink member 10. Although, the rectangular-prism-shaped hot melt ink member 10' is shown in FIG. 4, the hot melt ink member 10' can be formed in any prism shape.

It should be noted that the heater 20 can be formed with a plurality of through-holes rather than the elongated single through-hole 21. That is, the heater 20 can be formed in any form as long as ink can be supplied evenly on the entire area of the ink carrying member 30.

Next, an image forming device 1*d* according to a third embodiment of the preset invention will be described while referring to in FIGS. 5 and 6. Although the image forming devices 1*a*, 1*b* of the first and second embodiments are for forming images directly on a recording medium, the image forming device 1*d* of the present embodiment is for forming multicolor images using an intermediate transfer body.

Figure 5:
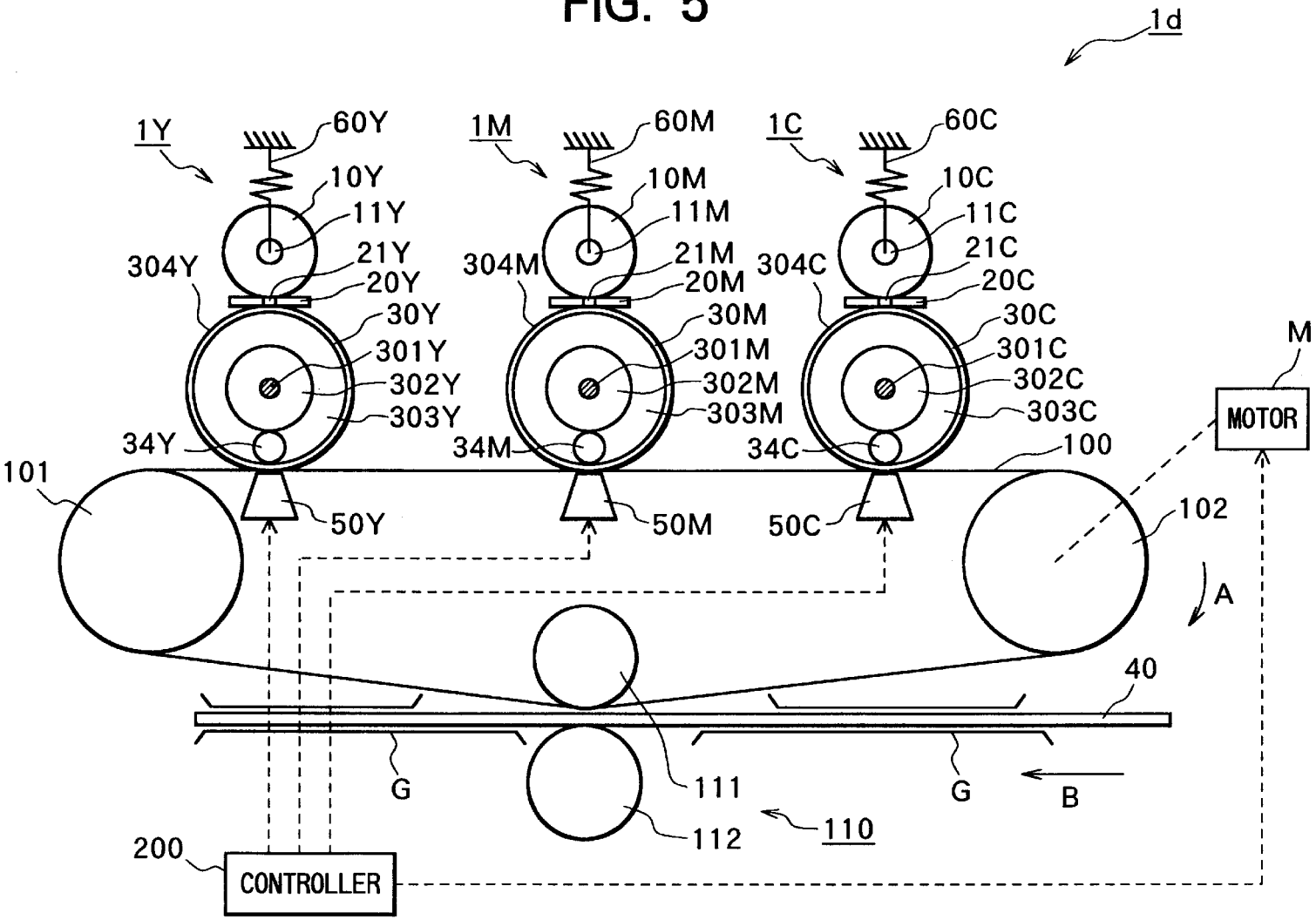
FIG. 5 is a plan view showing an image forming device according to a third embodiment of the present invention.
Figure 6:
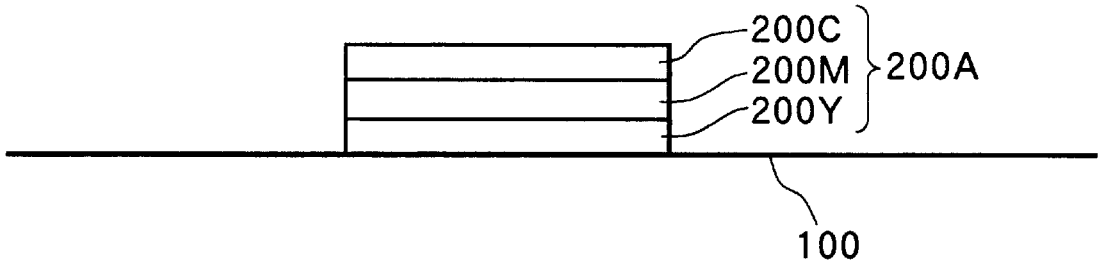
FIG. 6 is a plan view showing a multicolored image formed on an intermediate transfer body of the image forming device of FIG. 5.

As shown in FIG. 5, the image forming device 1*d* includes, an intermediate transfer body 100, image forming units 1Y, 1M, 1C, and a transfer unit 110. Each of the image forming units 1Y, 1M, 1C is for forming a colored image on the intermediate transfer body 100 using one of different colored inks, that is, yellow ink, magenta ink, and cyan ink. The different colored images are formed in selectively overlapping relation for forming a single multicolor image on the intermediate transfer body 100. The multicolor image is transferred from the intermediate transfer body 100 onto a recording medium 40 by the transfer unit 110. The transfer unit 110 includes a thermal roller 111 and a platen roller 112.

The image forming device 1*d* further includes a pair of driving rollers 101, 102, a drive motor M having an output shaft, sheet guides G, and a controller 200. The intermediate transfer body 100 is an endless thin film wound around the driving rollers 101, 102 and the thermal roller 111. A gear mechanism (not shown) connects the output shaft of the motor M to the driving rollers 101, 102 and the thermal roller 111 so that the rollers 101, 102, 111 rotate at a predetermined speed in accordance with rotational movement of the motor M. The driving rollers 101, 102 and the thermal roller 111 feed the intermediate transfer body 100 in a clockwise direction as indicated by an arrow A in FIG. 5. The intermediate transfer body 100 is preferably formed of a thermal-resistant material, such as polyamide.

The thermal roller 111 includes an internal heater (not shown). The heater generates heat to maintain the thermal roller 111 at a predetermined temperature. The platen roller 112 is urged toward the thermal roller 111 so that a nip portion is developed between the platen roller 112 and the thermal roller 111. The sheet guides G have flat surfaces for guiding a recording medium 40 supplied from outside of the image forming device 1*d* in a direction indicated by an arrow B. A leading edge of the recording medium 40 is guided to the nip portion between the thermal roller 111 and the platen roller 112. The recording medium 40 and the intermediate transfer body 100 are transported at the same feeding speed. A multicolor image formed on the intermediate transfer body 100 in a manner to be described later is thermally transferred onto the recording medium 40 by the thermal roller 111. After the intermediate transfer body 100 and the recording medium 40 pass through the nip portion, they are further fed in directions away from each other so that the recording medium 40 is separated from the intermediate transfer body 100. Then, the recording medium 40 is discharged out of the image forming device 1*d*.

A portion of the intermediate transfer body 100 stretched taut between the driving rollers 101, 102 extends in a substantially horizontal direction. The image forming units 1Y, 1M, 1C are disposed in this order above the horizontally-extending-portion of the intermediate transfer body 100. It is preferable that adjacent ones of the image forming units 1Y, 1M, 1C be disposed with a sufficient distance therebetween to allow ink transferred onto the intermediate transfer body 100 by one image forming unit to semi-solidify before reaching a subsequent image forming unit.

Because each of the image forming units 1Y, 1M, 1C has the same structure, only the image forming unit 1Y will be described to avoid duplicating description. It should be noted that like parts and components are designated by the same reference numerals with Y, M, or C to represent a component from the image forming unit 1Y, 1M, or 1C, respectively.

The image forming unit 1Y includes a hot melt ink member 10Y, a heater 20Y, an ink carrying unit 30Y, and a thermal head 50Y. The heater 20Y generates heat to melt the hot melt ink member 10Y. Melted ink from the hot melt ink member 10Y is supplied to and held on the ink carrying unit 30Y. The thermal head 50Y generates heat to selectively thermally transfer the ink by the ink carrying unit 30Y onto the intermediate transfer body 100.

The hot melt ink member 10Y is in its solid state at room temperature and melts when heated. The hot melt ink member 10Y is formed in a roller shape around a shaft 11Y, and is supported on the shaft 1Y so as to be slowly rotatable in accordance with the rotational movement of the motor M.

The ink carrying unit 30Y is disposed in confrontation with the hot melt ink member 10Y. The ink carrying unit 30Y includes a shaft 301Y, a gear 302Y, a roller 303Y, and an ink carrying member 304Y. The roller 303Y is formed in a cylindrical shape from a resin. The ink carrying member 304Y is fixedly attached to an outer peripheral surface of the roller 303Y. The gear 302Y is fixedly attached to the outer periphery of the roller 303Y in a coaxial relation with the roller 303Y. Both the gear 302Y and the roller 303Y are rotatably mounted on the shaft 301Y. The driving gear 34Y is engaged with the gear 302Y. The driving gear 34Y rotates at a predetermined speed in accordance with rotational movement of the motor M. In this way, the rotational movement of the motor M is transmitted to and rotates the roller 303Y and the ink carrying member 304Y in a counterclockwise direction in FIG. 5. The peripheral speed of the ink carrying member 304Y is the same as the feeding speed of the intermediate transfer body 100.

The heater 20Y is sandwiched between the hot melt ink member 10Y and the ink carrying unit 30Y. The heater 20Y is a thin-film heater made from stainless steel and formed with an elongated through-hole 21Y. The urging member 60Y urges the hot melt ink member 10Y toward the ink carrying unit 30Y. In this way, upper and lower surfaces of the heater 20Y contact the hot melt ink member 10Y and the ink carrying member 304Y, respectively. The through-hole 21Y exposes the hot melt ink member 10Y to the ink carrying member 304Y. The hot melt ink member 10Y, the ink carrying unit 30Y, the heater 20Y, and the through-hole 21Y of the heater 20Y all extend in parallel with each other in a longitudinal direction, that is, a direction perpendicular to the sheet surface of FIG. 5. In this embodiment, the dimension of each component in the longitudinal direction will be referred to as its width. The width of the through-hole 21Y is equal to or slightly smaller than the width of the ink carrying member 304Y, and also equal to or slightly greater than the width of the hot melt ink member 10Y. Although not shown in the drawings, the heater 20Y has a resister electrically connected to a power source. The resister is disposed on either entire or partial surface of the heater 20Y. The resister generates heat upon receiving electric power from the power source so as to melt the hot melt ink member 10Y. Melted ink flows down through the through-hole 21Y and supplied onto the ink carrying member 304Y.

The ink carrying member 304Y is made of ceramic fibers bound by a binder, such as a resin. The ceramic fibers are formed to a diameter of about 2 $\mu$m from a material containing alumnae and silica by thermal processes. The ceramic fibers have a melting point of 1700° C. The ink carrying member 304Y has excellent heat resistance and electric insulating properties and also has numerous apertures or spaces therein. The melted ink supplied through the through-hole 21Y spreads throughout the spaces and solidified therein. The ink carrying member 304Y can be also formed with through-holes extending in its thickness direction. In this case, the melted ink can be also held and solidified in the through-holes.

It should be noted that the ink carrying unit 30Y can be formed in any endless from, such as belt shape, as long as it is able to hold melted ink. The ink carrying unit 30Y can be formed from porous resin. However, it is preferable to be formed from ceramics having excellent heat resistance properties for the reason that the ink carrying unit 30Y is repeatedly subjected to heat.

The shaft 301Y of the ink carrying unit 30Y extends parallel with the axial direction of the driving rollers 101, 102. The intermediate transfer body 100 contacts, and is sandwiched between, the ink carrying member 304 and the thermal head 50. Although not shown in the drawings, the thermal head 50Y has a plurality of heating elements arranged in an element line extending in the longitudinal direction to a width equal to the width of the ink carrying member 304Y. The heating elements are urged to contact the intermediate transfer body 100.

The heating elements of the thermal head 50Y are individually connected to the controller 200. ON/OFF state and heat amount from each heating element is controlled by the controller 200. The controller 200 includes a well-known logic-arithmetic circuit having a CPU, a ROM, and a RAM. The controller 200 receives color image data from an external device and stores the data in the RAM. Bitmap data for yellow color, magenta color, and cyan color is generated based on the color image data. The bitmap data is stored in a predetermined region of the RAM. The CPU controls each heating element of the thermal heads 50Y, 50M, 50C to generate heat based on the bitmap data.

Next, a printing operation of the above-described image forming device 1*d* will be described. First, the heater 20Y generates heat to melt the hot melt ink member 10Y. Melted ink from the hot melt ink member 10Y is supplied onto the ink carrying member 304Y through the through-hole 21Y. The ink then spreads throughout the apertures or spaces formed in the ink carrying member 304Y and solidifies in the apertures. As the ink carrying unit 30Y rotates, the ink is brought into a position confronting the thermal head 50Y. Upon receiving bitmap data for yellow color from the controller 200, the heating elements of the thermal head 50Y selectively generate heat to thermally transfer the ink onto the intermediate transfer body 100. That is, heat from the heating elements heats up a portion of the ink carrying member 304Y. Ink held in the heated portion is melted and supplied onto the intermediate transfer body 100 being fed in the direction A. In this way, a yellow-color image 200Y is formed on the intermediate transfer body 100 as shown in FIG. 6.

Then, the intermediate transfer body 100 with the yellow-color image 200Y formed thereon is further fed toward the image forming unit 1M. The image forming unit 1M performs a printing operation in the same manner as the above-described image forming unit 1Y. That is, the controller 200 transmits bitmap data for magenta color to the thermal head 50M. The heating elements of the thermal head 50M selectively generate heat based on the data. The magenta ink on the ink carrying member 304M is thermally transferred onto the yellow-color image 200Y on the intermediate transfer member 100. In this way, a magenta-color image 200M is formed on the yellow-color image 200Y as shown in FIG. 6.

The intermediate transfer body 100 with the yellow-color image 200Y and the magenta-color image 200M formed thereon is further fed toward the image forming unit 1C. The image forming unit 1C performs printing operation in the same manner as the image forming units 1Y, 1M described above. That is, the heating elements of the thermal head 50C selectively generate heat based on bitmap data for cyan color transmitted by the controller 200. The cyan ink on the ink carrying member 304C is thermally transferred onto the magenta-color and yellow-color images 200M, 200Y to form a cyan-color image 200C thereon as shown in FIG. 6. In this way, a multicolor image 200A is formed on the intermediate transfer body 100.

Then, the intermediate transfer body 100 with the multicolor image 200A formed thereon is further fed to the nip portion between the platen roller 112 and the thermal roller 111. The multicolor image 200A is thermally transferred from the intermediate transfer body 100 onto the recording medium 40 by the thermal roller 111 generating heat. In this way, a desired multicolor image is formed on a recording medium 40.

Because an image is first formed onto the intermediate transfer body 100 and then onto a recording medium 40, heat generated by the thermal head 50Y, 50M, 50C can be supplied to ink on the ink carrying member 304Y, 304M, 304C regardless of a thickness or material of the recording medium 40. Because the intermediate transfer body 100 is made of a thin film, heat generated by the thermal head 50Y, 50M, 50C can be efficiently supplied to the ink on the ink carrying member 304Y, 304M, 304C.

According to the present embodiment of the invention, the image forming units 1Y, 1M, 1C perform the printing operation for forming each color image 200Y, 200M, 200C on the intermediate transfer body 100 under predetermined conditions represented by the following formula F:

$$C_n W_n (T_n - T_r) \leq Q_n < (T_{n-1} - T_r) \sum_{m=1}^{n-1} C_m W_m \quad \text{(formula F)}$$

wherein $C_n$ is thermal capacity of the hot melt ink member 10Y, 10M, 10C;

$W_n$ is weight of ink to be thermally transferred onto the intermediate transfer body 100, that is, weight of ink in a single dot;

$T_n$ is temperature of the ink at which the ink is thermally transferred onto the intermediate transfer body 100;

$T_r$ is room temperature;

$Q_n$ is amount of heat to be supplied to the ink by the thermal head 50Y, 50M, 5C; and n is a number corresponding to the place of the corresponding one of the image forming units 1Y, 1M, 1C in the order in which the image forming units 1Y, 1M, 1C perform the printing operation.

Specifically, as shown in FIG. 5, the image forming units 1Y, 1M, 1C are disposed in this order from upstream to downstream in the feeding direction of the intermediate transfer body 100. Therefore, n=1 for the image forming unit 1Y, n=2 for the image forming unit 1M, and n=3 for the image forming unit 1C in the present embodiment. Amounts of heat $Q_1$, $Q_2$, $Q_3$ to be supplied by the thermal head 50Y, 50M, 50C to the yellow ink, magenta ink, cyan ink, respectively, during printing operations can be determined by the following formulas 1, 2, 3, respectively:

$$C_1 W_1 (T_1 - T_r) \leqq Q_1 \quad \text{(formula 1)}$$

$$C_2 W_2 (T_2 - T_r) \leqq Q_2 < C_1 W_1 (T_1 - T_r) \quad \text{(formula 2)}$$

$$C_3 W_3 (T_3 - T_r) \leqq Q_3 < (C_1 W_1 + C_2 W_2)(T_2 - T_r) \quad \text{(formula 3)}$$

wherein $C_1$, $C_2$, and $C_3$ are thermal capacities of the hot melt inks 10Y, 10M, 10C, respectively;

$W_1$, $W_2$, and $W_3$ are weights of yellow ink, magenta ink, and cyan ink to be thermally transferred, respectively, that is, weights of the inks forming dots;

$T_1$, $T_2$, and $T_3$, are temperatures of the inks at which the yellow ink, the magenta ink, and the cyan ink, respectively, are thermally transferred; and $T_r$ is room temperature.

Under these conditions, the yellow ink existing on the intermediate transfer body 100 requires greater heat energy $Q_1$ to be melted than the magenta ink held on the ink carrying member 304M. In other words, the heat $Q_2$ is sufficient for transferring the magenta ink onto the intermediate transfer body 100 but not for melting the yellow ink forming the yellow colored image 200Y. Also, a combined ink of the yellow ink and the magenta ink existing on the intermediate transfer body 100 requires greater heat energy Q to be melted than the cyan ink held on the ink carrying member 304C. That is, the heat $Q_3$ is sufficient for transferring the cyan ink onto the intermediate transfer body 100 but not for melting the yellow ink and the magenta ink collectively.

Therefore, the thermal head 50M can thermally transfer magenta ink from the ink carrying member 304M without disturbing a yellow-color image 200Y. Even though the thermal head 50M generates heat when the yellow-color image 200Y is positioned between the thermal head 50M and the ink carrying member 304M, yellow ink forming the yellow-color image 200Y can be maintained in its solid state without melted by the thermal head 50M. Therefore, the magenta-color image 200M can be formed on the yellow-color image 200Y without blurring the yellow-color image 200. Also, the thermal head 50C can thermally transfer cyan ink from the ink carrying member 304C without disturbing the yellow-color and magenta-color images 200Y, 200M. Because the yellow and magenta inks forming the yellow-color and magenta-color images 200Y, 200M can be maintained in the solid states even when the image forming unit 1C is performing the thermal-transfer operation to form 200C, a clear multicolor image 200A can be obtained.

Next, specific examples for performing the printing operations will be described. In these examples, one of thermal capacities $C_n$, ink amounts $W_n$, and ink temperatures $T_n$ are varied to form a clear multicolor image.

In a first example, thermal capacities $C_n$ of the hot melt inks 10Y, 10M, 10C is varied so as to be $C_1 > C_2 > C_3$ as described below.

The hot melt inks 10Y, 11M, 10C are made of compounds of dye, wax, and resin. Because the wax increases the thermal capacity of the hot melt inks 10Y, 10M, 10C, the thermal capacity of the compounds can be changed by changing ratio of wax in the compounds. That is, as the ratio of wax increases, the thermal capacities of the hot melt ink also increases.

It will be assumed that the hot melt inks 10Y, 10M, 10C are formed to have thermal capacities $C_n$ of 2 kJ/kg·K, 1.5 kJ/kg·K, and 1 kJ/kg·K, respectively, that using thus formed hot melt inks 10Y, 10M, 10C, printing operations are performed at a room temperature $T_r$ of 20° C., and that inks are set to be thermally transferred onto the intermediate transfer body 100 at a temperature $T_n$ of 125° C. with an amount $W_n$ of $5 \times 10^{-8}$ kg.

Under this condition, according to the formula F described above, a yellow color image 200Y can be formed with the thermal head 50Y supplying 10.5 mJ to yellow ink on the ink carrying member 304Y. Accordingly, heat amounts $Q_2$, $Q_3$ of heat for magenta ink, and cyan ink will be in a range from 7.9 to 10.5 mJ and in a range from 5.3 to 18.4 mJ, respectively.

In a second example, amounts of inks $W_n$ to be thermally transferred are varied so as to be W1>W2>W3.

The hot melt inks 10Y, 11M, 10C are made of compounds of dye, wax, and resin as described above. When ratios of the dyes are increased, color densities of the inks 10Y, 11M, 10C can be increased. When the color densities of the inks 10Y, 11M, 10C are varied, the amounts of inks required for forming images with a predetermined density also vary.

Therefore, different amounts $W_n$ of yellow ink, magenta ink, and cyan ink will be transferred during thermal transfer operations.

It will be assumed that the image forming units 1Y, 1M, 1C perform printing operations at a room temperature $T_r$ of 20° C. using inks having the same thermal capacity $C_n$ of 2 kJ/kg·K, that yellow ink, magenta ink, and cyan ink are thermally transferred onto the intermediate transfer body 100 at the same temperatures $T_n$ of 125° C. and that the image forming unit 1Y thermally transfers yellow ink of $5\times10^{-8}$ kg by the 50Y supplying heat of 10.5 mJ.

In this case, the image forming unit 1M can thermally transfer magenta ink of $4\times10^{-8}$ kg by supplying heat in a range from 8.4 to 10.5 mJ. Also, the image forming unit 1C can thermally transfer cyan ink of $3\times10^{-8}$ kg by supplying heat in a range from 6.3 to 18.9 mJ.

In a third example, temperatures $T_n$ of inks to be thermally transferred are varied so as to be $T_1>T_2>T_3$.

The hot melt inks 10Y, 11M, 10C are made of compounds of dye, wax, and resin as describe above. The wax includes a variety of components, such as paraffin wax. By changing molecule weights of components in the wax, melting points of the inks can be changed. As its melting point increases, an ink must be heated to an increased temperature $T_n$ to be thermally transferred onto the intermediate transfer body 100. That is, as increasing the molecule weight ink wax of each ink 10Y, 11M, 10C in this order, temperature $T_n$ also increases in this order.

It will be assumed that the image forming units 1Y, 1M, 1C perform printing operations at a room temperature $T_r$ of 20° C. using inks having the same thermal capacity $C_n$ of 2 kJ/kg·K and that a weight of $3\times10^{-8}$ kg yellow ink, magenta ink, and cyan ink is transferred onto the intermediate transfer body 100 for each dot.

In this case, according to the formula F described above, the thermal head 50Y needs to supply heat $Q_1$ of 10.5 mJ to yellow ink for thermally transferring the ink at a temperature of 125° C. When magenta ink and cyan ink are set to be thermally transferred onto the intermediate transfer body 100 at temperatures of 115° C., 105° C., respectively, the thermal head 50M needs to supply a heat $Q_2$ in a range from 9.5 to 10.5 mJ to the magenta ink, and the thermal head 50C needs to supply a heat $Q_3$ in a range from 8.5 to 19 mJ to the cyan ink.

Therefore, as described above, by supplying appropriate amounts of heat $Q_n$ to inks in accordance with the variety of thermal capacities $C_n$, ink amounts $W_n$, and ink temperatures $T_n$, a clear multicolor image can be obtained without changing time duration for thermally transferring different colored inks.

It should be noted that, although in the above described examples, only one parameter of thermal capacities $C_n$, ink amounts $W_n$, and ink temperatures $T_n$ is varied, any two or all parameters can be varied at the same time.

Although, in the above described embodiment, the image forming units 1Y, 1M, 1C are disposed in this order, the image forming units 1Y, 1M, 1C can be disposed in any order.

The image forming device **1*d* can include any two of the image forming units 1Y, 1M, 1C** rather than all three.

Also, the image forming device **1*d*** can include a plurality of image forming units for forming same color images with different tones rather than for forming the different color images.

Also, an additional image forming unit 1B for black color ink can be provided to the image forming device **1*d***. In this case, a formula 4 for the last one of the image forming units will be:

$$C_4W_4(T_4-T_r)\leqq Q_4<(C_1W_1+C_2W_2+C_3W_3)\ (T_4-T_r) \qquad \text{(formula 4)}$$

Figure 7:
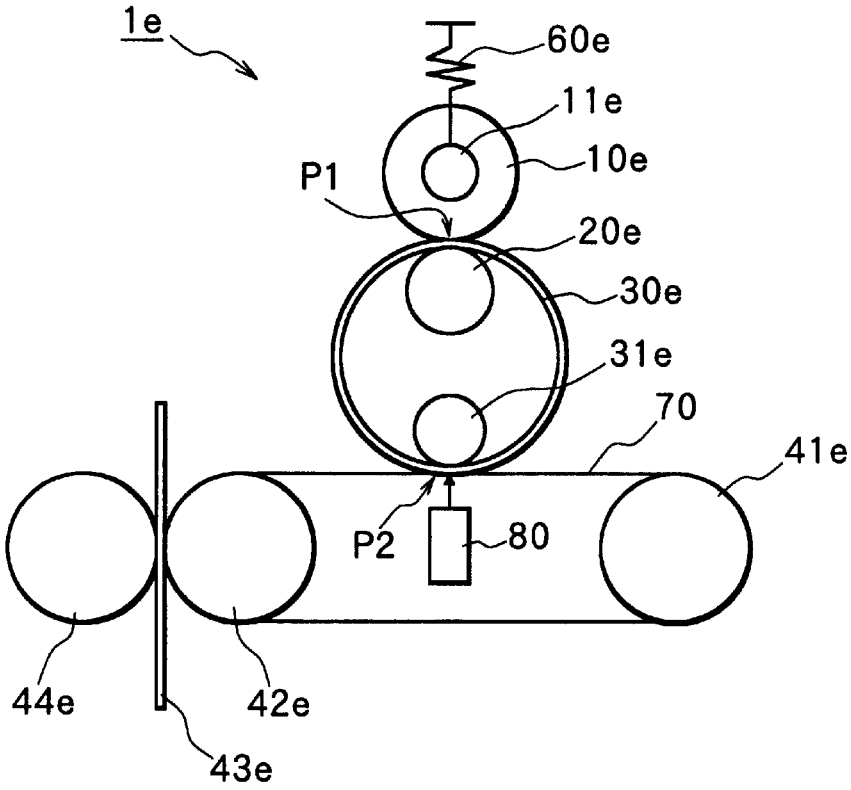
FIG. 7 is a plan view showing an image forming device according to a forth embodiment of the present invention.
Figure 8:
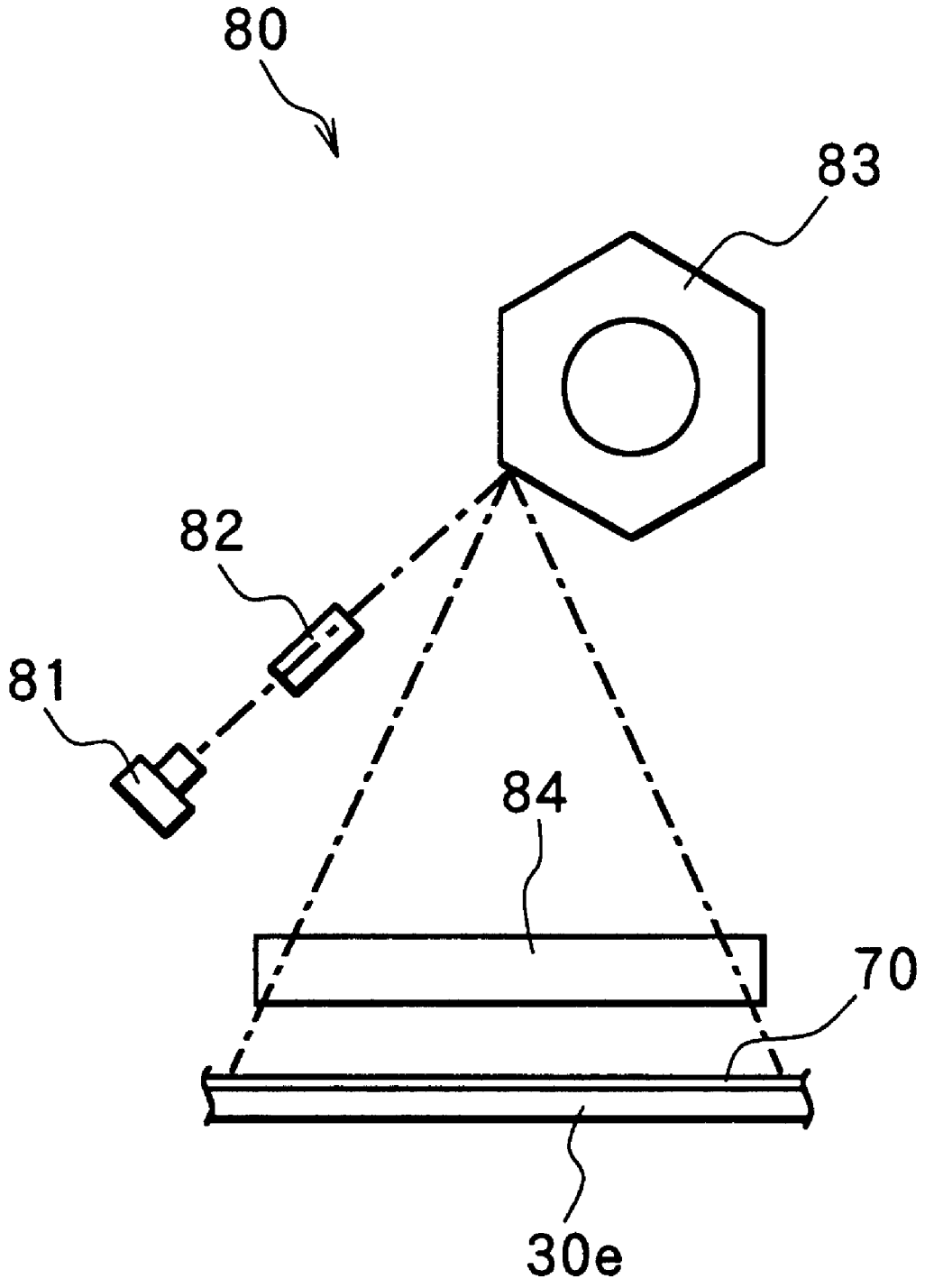
FIG. 8 is a plan view showing a laser unit of the image forming device of FIG. 7.

Next, an image forming device **1*e* according to a forth embodiment of the present invention will be described while referring to FIGS. 7 and 8. As shown in FIG. 7, the image forming device 1*e* includes a hot melt ink member 10*e*, a shaft 11*e*, an urging member 60*e*, a heater 20*e*, an ink carrying member 30*e*, a feed roller 31*e*, an intermediate transfer body 70, a laser unit 80, a roller 41*e*, a thermal roller 42*e*, and a sheet feed roller 44*e***.

The hot melt ink member **10*e* is in its solid state at room temperature and turns into its liquid state when heated. The hot melt ink member 10*e* is formed in a cylindrical shape around the shaft 11*e*. A drive member (not shown) drives the hot melt ink member 10*e* to rotate. The hot melt ink member 10*e* is disposed in contact with the ink carrying member 30*e*. The urging member 60 urges the hot melt ink member 10*e* via the shaft 11*e* to press against the ink carrying member 30*e*** with a predetermined pressing force.

The ink carrying member **30*e* is a sheet-like member which is formed of ceramic fibers bound by a binder, such as a resin. The ceramic fibers are formed from a material containing alumnae and silica. The ink carrying member 30*e* is rotatably supported by shaft receiver (not shown). The heater 20*e* and the feed roller 31*e* are both rotatably disposed in contact with an inner surface of the ink carrying member 30*e*. The feed roller 31*e* is connected to a driving circuit (not shown) and driven to rotate. The rotational movement of the feed roller 31*e* rotates the ink carrying member 30*e* at a predetermined speed. Also, the rotational movement of the ink carrying member 30*e* rotates the heater 20*e***.

The heater **20*e* is formed in a cylindrical shape, and has an internal heating element. Upon receiving electric energy from a power source (not shown), the heater 20*e* generates heat to melt the hot melt ink member 10*e* while rotated by the ink carrying member 30*e*. The melted ink is supplied onto the ink carrying member 30*e* at a first position P1. It should be noted that because the ink carrying member 30*e* is made of ceramics, the ink carrying member 30*e* has excellent durability. Also, by decreasing fiber density, more apertures or spaces can be formed among the fibers so that the ink carrying member 30*e*** can carry increased amounts of ink.

The intermediate transfer body 70 is wound around the rotatable roller **41*e* and thermal roller 42*e* and fed as the rollers 41*e* , 42*e* rotate. A portion of the intermediate transfer body 70 is in contact with the ink carrying member 30*e* at a second position P2** remote from the first position.

The laser unit 80 is disposed in confrontation with the second position P2 with the intermediate transfer body 70 interposed between the ink carrying member **30*e* and the laser unit 80. When ink supplied onto the ink carrying member 30*e* at the first position is brought to the second position P2 as the ink carrying member 30*e* rotates, the laser unit 80 selectively melts the ink based on print data transmitted from a print data generating device (not shown). Thus melted ink is transferred onto the intermediate transfer body 70 to form an image on the intermediate transfer body 70**.

The sheet feed roller **44*e* is disposed in contact with the thermal roller 42*e* with a nip portion developed therebetween. The sheet feed roller 44*e* is for feeding recording mediums 43, such as paper sheets and OHP sheets. The image formed on the intermediate transfer body 70 at the second position P2 is brought to the nip portion. The thermal roller 42** generates heat to thermally transfer the image onto the recording medium at the nip portion.

Next, the laser unit 80 will be described while referring to FIG. 8. As shown in FIG. 8, the laser unit 80 includes a laser source 81, an optical system 82, a polygon scanner 83, and a fθ lens 84. The laser source 81 is for radiating a modulated laser beam based on print data transmitted from a driving circuit (not shown). The radiated laser beam is converged by the optical system 82. The polygon scanner 83 is provided for changing a traveling direction of the laser beam into substantially perpendicular to the feed direction of the intermediate transfer body 70. A linear travel speed of the laser beam is controlled by the fθ lens 84. With this configuration, a modulated laser beam is emitted by the laser source 81, converged by the optical system 82, reflected by the polygon scanner 83, controlled its traveling speed by the fθ lens 84, and irradiated onto the surface of the ink carrying member 30. Since the laser unit 80 is of a well known type for use in electrophotograph printing devices, detailed descriptions will be omitted.

It should be noted that a LED radiating device having LED array and selphoc lens, or liquid crystal shatter radiating device including a liquid crystal medium and an opening unit can be used rather than the laser unit 80. Also, a galvanic scanner can be used rather than the polygon scanner 83.

Next, positional relationship between the first position P1 and the second position P2 will be described.

The positional relationship between the first position P1 and the second position P2 is set as represented by a following formula:

$$v \times t1 > L > v \times t2$$

wherein L is peripheral distance on the ink carrying member 30*e* between the position P1 and the position P2;

v is outer peripheral speed of rotational movement of the ink carrying member 30*e;* t1 is time duration required for melted ink which is supplied onto the ink carrying member 30*e* at the position P1 to cool down to the room temperature and solidify; and t2 is time duration required for melted ink which is supplied onto the ink carrying member 30*e* at the position P1 to cool down to be its semisolid state in which the ink will not be transferred onto the intermediate transfer body 70 when contacting the intermediate transfer body 70 unless the ink is supplied with heat energy form the laser unit 80.

It should be noted that the speed v can be obtained from an output speed from the image forming device 1*e*. For example, for outputting a A4-sized sheet with its longitudinal direction being parallel with the sheet feed direction, the rotational speed of the ink carrying member 30*e* will be approximately 50 mm/s.

Next, operations of the image forming device 1*e* will be described. The hot melt ink member 10*e* is melted by heat generated by the heater 20*e* and supplied onto the ink carrying member 30*e* at the first position P1. The melted ink is spread throughout the outer surface of the carrying member 30*e* and held thereon. As the ink carrying member 30*e* is fed by the feed roller 31*e,* the ink is brought into confrontation with the laser irradiating unit 80 at the second position P2. The laser unit 80 selectively irradiates a laser beam onto the ink on the ink carrying member 30*e*. The ink is thermally transferred from the ink carrying member 30*e* onto the intermediate transfer body 70, thereby forming an image thereon. Thus formed image at the position P2 is conveyed on the intermediate transfer body 70 toward the thermal roller 42*e*. The thermal roller thermally transfers the image onto the recording medium 43*e*.

Because the peripheral distance L is set to be less than the product of the outer peripheral speed and the time duration t1 (v×t1>L) as described above, the ink brought to the position P2 is in its semi-liquid or semisolid state. The semi-solid ink requires less heat energy to be thermally transferred onto the intermediate transfer body 70 than a completely solidified ink. Therefore, it requires a less time duration for thermal transfer operations.

Also, because the peripheral distance L is set to be larger than the product of the outer peripheral speed v and the time duration t2 (L>v×t2) as described above, the semi-solid ink will not be transferred onto the intermediate transfer body 70 unless a laser beam is irradiated thereon.

When different types of ink are used in the image forming device 1*e,* a distance L can be adjusted accordingly without changing a speed v. Specifically, when time durations t1, t2 are great, a distance L will be long. On the other hand, when the time durations t1, t2 are short, the distance L will be short. In either case, it is unnecessary to change the speed v. Because the speed v can be kept unchanged, there is no need to replace a mechanism for performing the printing operation.

Although an image is formed onto the intermediate transfer body 70 and, then, transferred onto the recording medium 43*e* in the present embodiment, the image can be formed directly onto the recording medium 43*e* at the second position P2 without using the intermediate transfer body 70.

Also, the laser unit 80 can be provided internally to the ink carrying member 30*e* rather than in confrontation with the ink carrying member 30*e*. In this case, the laser unit 80 can provide a predetermined uniform energy to the ink regardless of a thickness of the intermediate transfer body 70.

Also, a thermal head can be used rather than the laser unit 80.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. An image forming device comprising:

an intermediate medium; and an image unit forming that forms an image on the intermediate medium, the image forming unit including:

a hot melt ink supporting member that supports hot melt ink that is solid at room temperature and melted when heated;

a heater disposed in contact with the hot melt ink that is solid at room temperature, the heater generating heat to melt ink from the hot melt ink;

an ink carrying member supplied with ink melted from the hot melt ink to hold and carry the ink, the ink carrying member being movable and partially contacting the intermediate medium movable relative to the ink carrying member;

a thermal transferring member disposed in confrontation with the ink carrying member with the intermediate medium movably interposed therebetween that selectively transfers ink held on the ink carrying member onto the intermediate medium by selectively applying heat to the ink carrying member; and a recording member that transfers the ink on the intermediate medium onto a recording medium by applying heat to the ink on the intermediate medium from a side opposite to the recording medium with respect to the intermediate medium.

2. The image forming device according to claim 1, wherein the ink carrying member is formed in a roller shape rotatable around its own axis, the ink carrying member being supplied with ink at a first position, the ink carrying member transporting ink along a path, the ink carrying member partially contacting the intermediate medium at a second position remote from the first position; and wherein the thermal transferring member selectively transfers ink on the ink carrying member onto the intermediate medium at the second position, the ink on the ink carrying member being cooled to be a semi-solid state when moved to the second position from the first position so as not to allow the semi-solid state ink to be transferred onto the intermediate medium when the thermal transferring member does not apply heat to the ink carrying member.

3. The image forming device according to claim 2, wherein $$v \times t1 > L > v \times t2$$

wherein v is a moving speed of the ink carrying member; L is a distance between the first position and the second position along the path; t1 is a time duration required for the ink supplied onto the ink carrying member at the first position to solidify at room temperature; and t2 is a time duration required for the ink supplied onto the ink carrying member at the first position to be in the semi-solid state.

4. The image forming device according to claim 2, wherein the thermal transferring member is disposed in confrontation with the ink carrying member at the second position with the intermediate medium interposed therebetween.

5. The image forming device according to claim 2, wherein the thermal transferring member is disposed in confrontation with the intermediate medium at the second position with the ink carrying member interposed therebetween.

6. The image forming device according to claim 1, wherein the recording member is a thermal recording member.

7. The image forming device according to claim 1, wherein the ink carrying member comprises a porous sheet that absorbs and retains ink thereon, the sheet being made of ceramic fibers.

8. The image forming device according to claim 7, wherein the sheet has a thickness in a thickness direction and is formed with a plurality of through-holes in which a substantial amount of ink is held, the through-holes extending in the thickness direction of the sheet.

9. The image forming device according to claim 1, wherein the heater is formed with a through-hole through which ink melted from the hot melt ink in the solid state is supplied onto the ink carrying member, the heater being disposed between the hot melt ink supported by the hot melt ink supporting member and the ink carrying member.

10. The image forming device according to claim 1, wherein a plurality of image forming units are provided each forming an image on the intermediate medium using different type hot melt inks, the plurality of image forming units forming images in selectively overlapping relation so as to form a single image.

11. The image forming device according to claim 10, wherein the different type hot melt inks differ in ink color.

12. The image forming device according to claim 10, wherein the different type hot melt inks are of the same color but different in color density.

13. The image forming device according to claim 10, wherein the thermal transferring member of each image forming unit selectively supplies heat energy to ink held on the ink carrying member so that the ink is melted and transferred onto the intermediate medium; and wherein the thermal transferring member of an $n^{th}$ image forming unit of the plurality of image forming units selectively transfers ink on the ink carrying member onto the intermediate medium under a condition represented by a following formula:

$$C_n W_n (T_n - T_r) \leq Q_n < (T_{n-1} - T_r) \sum_{m=1}^{n-1} C_m W_m$$

wherein $Q_n$ is a heat amount supplied to the ink from the thermal transferring member;

$T_n$ is a temperature of the ink when transferred onto the intermediate medium;

$W_n$ is a weight of the ink transferred onto the intermediate medium;

$C_n$ is a thermal capacity of the ink; and $T_r$ is room temperature.

14. The image forming device according to claim 1, wherein the ink carrying member has an endless belt-like sheet that is repeatedly supplied with ink melted from hot melt ink.

15. The image forming device according to claim 1, wherein the thermal transferring member is a thermal head including a plurality of heating elements.

16. The image forming device according to claim 1, wherein the thermal transferring member is an optical system selectively irradiating an optical beam onto the ink held on the ink carrying member.

17. The image forming device according to claim 1, wherein the hot melt ink supporting member urges the hot melt ink in a solid state against the heater.

18. The image forming device according to claim 1, wherein the thermal transferring member locally heats only a portion of the ink carrying member contacting the intermediate medium.

19. An image forming device comprising:

a hot melt ink supporting member that supports hot melt ink that is solid at room temperature and melted when heated;

a heater disposed in contact with the hot melt ink that is solid at room temperature, the heater generating heat to melt ink from the hot melt ink;

an ink carrying member supplied with ink at a first position, the ink carrying member being movable to transport the ink to a second position remote from the first position;

a recording medium supplying member that supplies a recording medium to the second position at which the recording medium contacts the ink carrying member; and a thermal transferring member that selectively transfers ink held on the ink carrying member onto the recording medium at the second position; wherein the ink on the ink carrying member is cooled to be a semi-solid state when moved to the second position from the first position so as not to allow the semi-solid state ink to be transferred onto the recording medium when the thermal transferring member does not apply heat to the ink carrying member, and $$v \times t1 > L > v \times t2$$

wherein v is a moving speed of the ink carrying member; L is a distance between a first position and a second position along a path of movement; t1 is a time duration required for the ink supplied onto the ink carrying member at the first position to solidify at room temperature; and t2 is a time duration required for the ink supplied onto the ink carrying member at the first position to be in the semi-solid state.

20. The image forming device according to claim 19, wherein the ink carrying member is a roller having a peripheral surface covered with an ink carrying sheet made of ceramic fibers, the ink carrying sheet being formed with a plurality of apertures in which the ink is held.

21. The image forming device according to claim 19, wherein the ink carrying member is formed in a sheet-like shape.

22. The image forming device according to claim 19, wherein the thermal transferring member locally heats only a portion of the ink carrying member contacting the recording medium.

23. A method of forming an image on a medium with an $n^{th}$ image forming unit of a plurality of image forming units, the method comprising the step of:

supplying heat $Q_n$ to ink held on an ink carrying member for heating the ink to a temperature $T_n$, the ink having a weight $W_n$ and a heat capacity of $C_n$, wherein $$C_n W_n (T_n - T_r) \leq Q_n < (T_{n-1} - T_r) \sum_{m=1}^{n-1} C_m W_m$$

wherein $T_r$ is room temperature so that the ink is transferred onto a medium.

* * * * *